US006220957B1

(12) United States Patent
Clarkson

(10) Patent No.: US 6,220,957 B1
(45) Date of Patent: Apr. 24, 2001

(54) REVERSING SHUTTLE FOR AIR HANDLING DEVICE

(75) Inventor: Christopher B. Clarkson, Jamesville, NY (US)

(73) Assignee: SubAir, Inc., Munnsville, NY (US)

( * ) Notice: Subject to any disclaimer, the term of this patent is extended or adjusted under 35 U.S.C. 154(b) by 0 days.

(21) Appl. No.: 09/310,303

(22) Filed: May 12, 1999

(51) Int. Cl.[7] ..... E02B 11/00
(52) U.S. Cl. ..... 454/256; 405/36; 454/338
(58) Field of Search ..... 454/256, 338, 454/254; 47/1.01 R, 1.01 F; 405/37, 36

(56) References Cited

U.S. PATENT DOCUMENTS

| | | | | |
|---|---|---|---|---|
| 1,695,784 | * | 12/1928 | Sternberg | 454/338 |
| 1,695,804 | * | 12/1928 | Feinberg | 454/338 X |
| 2,089,560 | * | 8/1937 | Kurth | 454/338 |
| 2,554,633 | * | 5/1951 | Orear | 454/338 |
| 5,433,759 | | 7/1995 | Benson | 47/1.01 |
| 5,464,370 | | 11/1995 | Shimizu et al. | 454/345 |
| 5,507,595 | | 4/1996 | Benson | 405/43 |
| 5,542,208 | | 8/1996 | Benson | 47/1.01 |
| 5,596,836 | | 1/1997 | Benson | 47/1.01 |
| 5,617,670 | | 4/1997 | Benson | 47/1.01 |
| 5,636,473 | | 6/1997 | Benson | 47/58 |

FOREIGN PATENT DOCUMENTS

| | | |
|---|---|---|
| 10 35 434 | 7/1958 | (DK) . |
| 48 678 | 11/1995 | (NL) . |
| WO 99 11955 | 3/1999 | (WO) . |

* cited by examiner

*Primary Examiner*—Harold Joyce
(74) *Attorney, Agent, or Firm*—Brown & Michaels, PC

(57) ABSTRACT

A fan unit has inlet and outlet ducts facing in the same direction. A reversing shuttle is connected to the inlet and outlet ducts of the fan unit and includes a diverter damper and two opposing dampers. The reversing shuttle further includes an outlet that is connectable to a duct network that is under a sports field or portions of a golf course. When the fan unit is running, depending on how the opposing dampers and diverter damper are positioned, air is either blown into the duct network, thereby causing air and possibly other additives to enter the soil profile of the field, or sucked (vacuumed) from the duct network, thereby draining moisture through the soil profile and into the duct network. Moving the diverter damper from a first position to a second position while changing which of the opposing dampers is open and which is closed reverses the air flow in the duct network.

7 Claims, 3 Drawing Sheets

Fig. 3
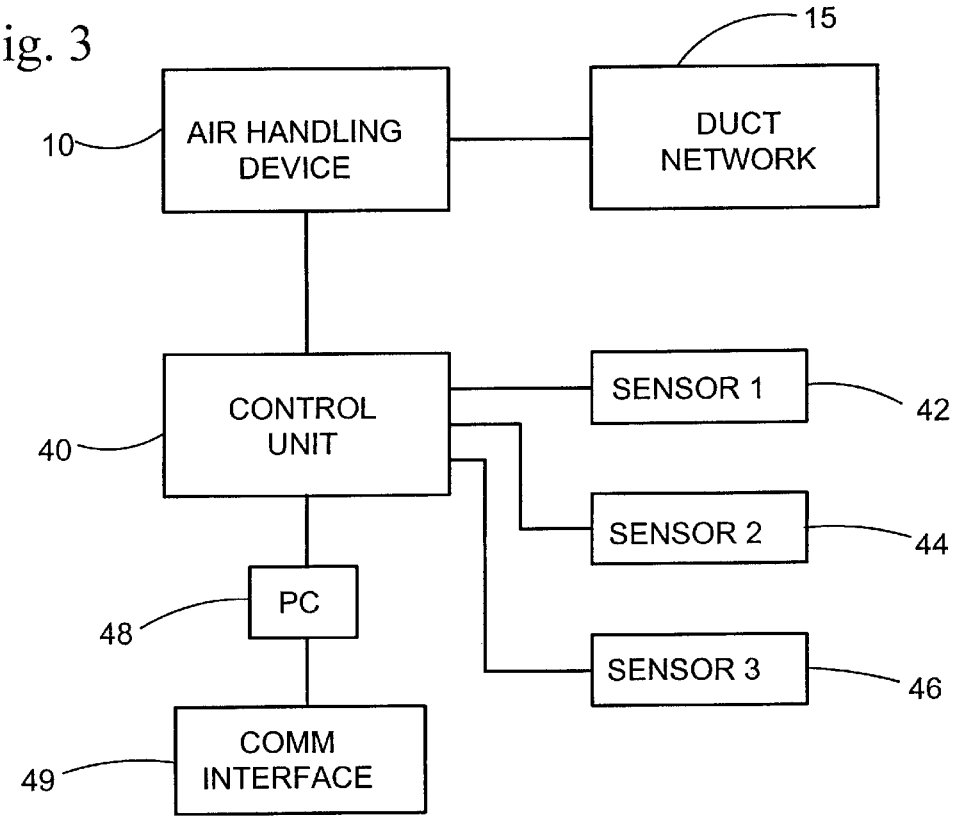
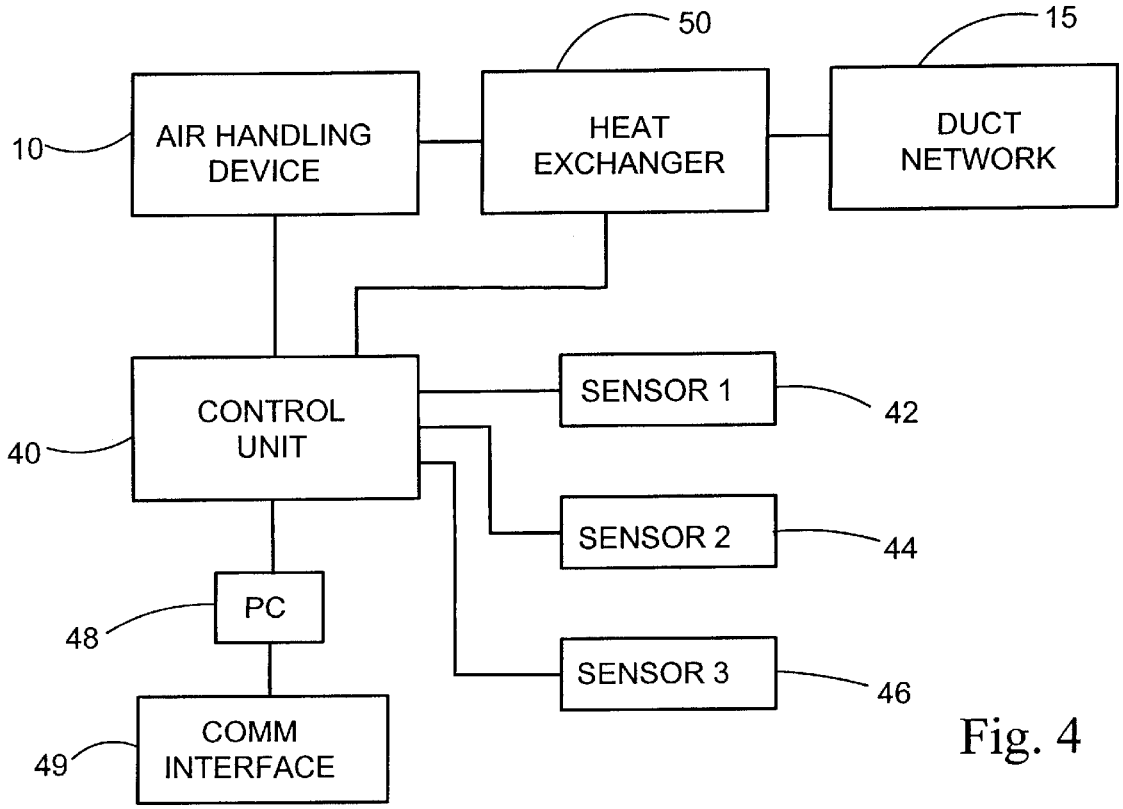
Fig. 4

REVERSING SHUTTLE FOR AIR HANDLING DEVICE

FIELD OF THE INVENTION

The invention pertains to the field of air handling devices. More particularly, the invention pertains to a reversing shuttle for an air handling device that reverses air flow in part of the device.

BACKGROUND OF THE INVENTION

In a system for treating soil and turf by blowing and/or vacuuming through a duct network located underneath the turf, a low-pressure high-volume fan is typically used to move air into the soil profile or suck moisture out of the soil profile. U.S. Pat. Nos. 5,433,759; 5,507,595; 5,542,208; 5,617,670; 5,596,836; and 5,636,473 show different variations on equipment used for this purpose. Since a non-reversing fan always rotates in the same direction, changing the system from a blowing function to a vacuuming function requires disconnecting the duct network from the blowing outlet of the fan unit and connecting it to the vacuum inlet of the unit. In some variations, a 4-way valve is used to avoid the hassles involved with selectively connecting and disconnecting the duct network from the various ports of the fan unit.

SUMMARY OF THE INVENTION

Briefly stated, a fan unit has inlet and outlet ducts facing in the same direction. A reversing shuttle is connected to the inlet and outlet ducts of the fan unit and includes a diverter damper and two opposing dampers. The reversing shuttle further includes an outlet that is connectable to a duct network that is under a sports field or portions of a golf course. When the fan unit is running, depending on how the opposing dampers and diverter damper are positioned, air is either blown into the duct network, thereby causing air and possibly other additives to enter the soil profile of the field, or sucked (vacuumed) from the duct network, thereby draining moisture through the soil profile and into the duct network. Moving the diverter damper from a first position to a second position while changing which of the opposing dampers is open and which is closed reverses the air flow in the duct network.

BRIEF DESCRIPTION OF THE DRAWINGS

FIG. 3 shows a schematic view of the air handling device as part of a larger air handling system according to an embodiment of the invention.

FIG. 4 shows a schematic view of an embodiment of the air handling system of the present invention.

DESCRIPTION OF THE PREFERRED EMBODIMENT

Figure 1:
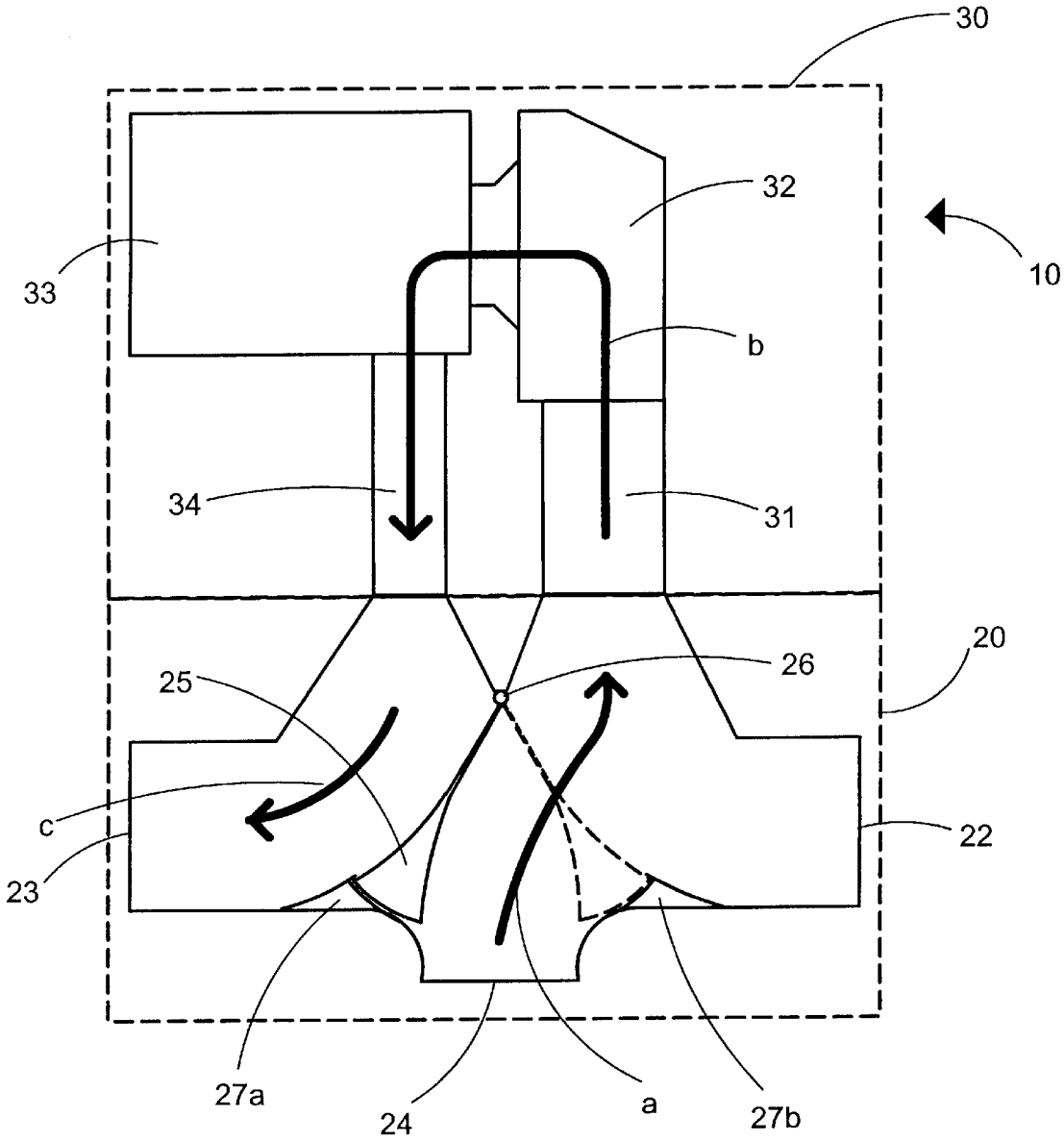
FIG. 1 shows a top plan schematic view of a reversing shuttle according to an embodiment of the invention as used in an air handling device.

Referring to FIG. 1, an air handling device 10 includes a reversing shuttle 20 that is connected to a fan box 30. Reversing shuttle 20 includes a vacuum side damper 22 on one side and a pressure side damper 23 on another side. A connection portion 24 connects to a supply line (not shown)

that connects air handling device 10 to a duct network 15 (FIG. 3) of a sports field (not shown). Dampers 22, 23 are preferably linked together so that when one damper is closed, the opposite damper is open, and vice versa. Dampers 22, 23 can be opposed operation actuated dampers to ensure that dampers 22, 23 are in opposed operation. A diverter damper 25 extends from a pivot point 26 to a seat 27*a* when air handling device 10 is in a vacuum mode and to a seat 27*b* when air handling device 10 is in a blowing mode. Diverter damper 25 and seats 27*a*, 27*b* are preferably curved so as to avoid inefficiencies in the system by minimizing turbulence and maintaining laminar flow.

Diverter damper 25 is preferably of carbon steel, but other materials that are suitably strong and durable can be used. Diverter damper 25 is preferably manually, electrically, or pneumatically actuated. When electrically or pneumatically actuated, a separate manual control is optional. Diverter damper 25 could be hydraulically actuated, but for most applications, this is not required.

Fan box 30 includes a fan inlet 31 which is connected on one end to an inlet box 32 and on the other end to reversing shuttle 20. Inlet box 32 is in turn connected to a fan housing 33 which preferably contains a conventional impeller type fan (not shown), although selecting the particular type of fan for a given installation is within the ability of one skilled in the art. Fan housing 33 is connected to a fan outlet 34 which in turn is connected to reversing shuttle 20. The geometries of fan inlet 31 and fan outlet 34 are such as to prevent inefficiencies in the system due to turbulence.

When diverter damper 25 is positioned as shown in FIG. 1, air enters reversing shuttle 20 via connector 24 as shown by arrow (a) because damper 22 is closed and damper 23 is open. The air moves through fan box 30 as shown by arrow (b) and exits to atmosphere through reversing shuttle 20 as shown by arrow (c).

Figure 2:
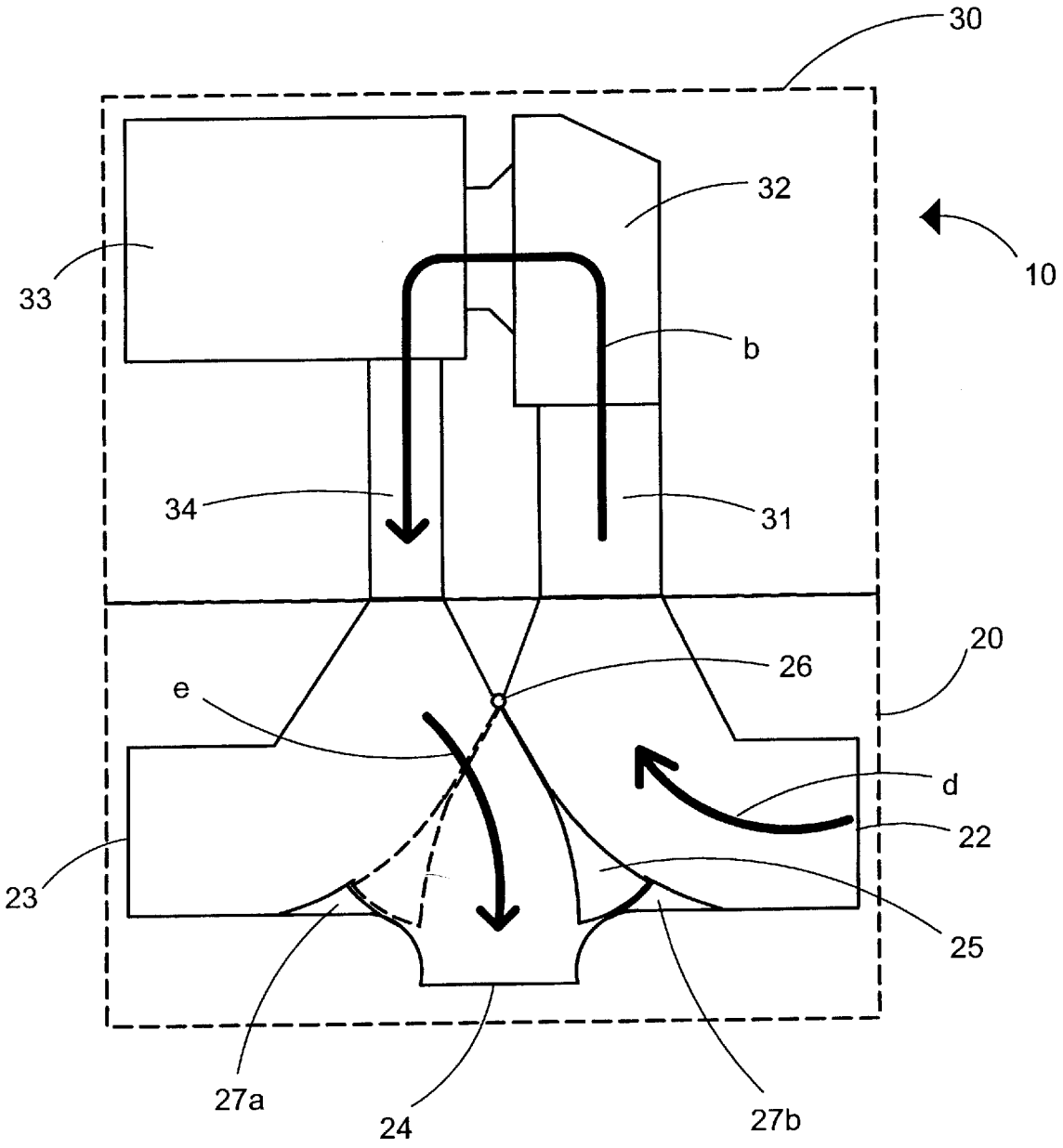
FIG. 2 shows a top plan schematic view of the reversing shuttle of FIG. 1 used to explain the operation of the invention.

Referring to FIG. 2, diverter damper 25 is seated against seat 27*b* and damper 22 is open while damper 23 is closed. The air therefore enters reversing shuttle 20 as shown by arrow (d), moves through fan box 30 as shown by arrow (b), and exits reversing shuttle 20 through connector 24 as shown by arrow (e).

Referring to FIG. 3, an embodiment of the invention has dampers 22, 23 and diverter damper 25 automatically controlled by a control unit 40 that preferably includes a microcontroller (not shown) operating to a control logic preferably input by a user via a device such as a PC 48. The PC 48 is optionally connected to a communications interface 49 such as a dial-in modem or internet connection to permit remote programming of the control logic. A plurality of sensors 42, 44, 46 that measure variables such as temperature, moisture, composition of soil gasses, etc, are linked to reversing shuttle 20 via control unit 40 to automatically control the direction of air flow through duct network 15. This is critical when operating air handling device 10 in an automatic mode, because if the turf being treated contains too much moisture, blowing air from air handling device 10 through duct network 15 can accidentally blow the turf out of the field in spots. Contrariwise, operating air handling device 10 in a vacuum mode when the turf is already dry will suck needed moisture out of the turf. Appropriate sensors such as those manufactured by Aqua-Flex, of New Zealand, placed in or just under the turf, preferably within the root zone or just below, permit proper automatic control of air handling device 10.

Referring to FIG. 4, an embodiment of the invention includes a heat exchanger 50 to maintain the turf at a desired temperature. For example, soccer pitches in Europe must be natural turf instead of artificial turf, and the turf/ground cannot be so frozen such that the players' cleats are unable to make an impression in the turf/ground. Temperature sensors strategically located around the pitch are tied in to control unit 40 which is connected to heat exchanger 50. The control logic for control unit 40 is preferably programmable by the user to maintain optimal field conditions using temperature and moisture as the variables to control the direction of air movement, time that air is being moved, and the temperature of the air being moved into the duct network as the operating parameters of the air handling system. In an alternate embodiment, control unit 40 can be optionally set to control the operating parameters based on time of day and season.

Another consideration when operating the invention in climates where freezing is likely to occur is that the specific heat of sand, which is frequently used in sports field construction, is 0.2 BTU/lb-deg F., which is only one-fifth that of water. Removing excess moisture from a sports field before the field freezes significantly reduces the amount of heat required to unfreeze the field and place it in condition suitable for sports play. In a variation of this embodiment, a supply line between air handling device 10 and duct network 15 is buried underground a sufficient depth to take advantage of ground effect heat exchange. The term "heat exchanger" as used in this application includes such a buried supply line.

An alternate embodiment of the air handling system of the present invention uses manual decision-making instead of programmed logic. The output from sensors 42, 44, 46 is shown on the screen of PC 48 and interpreted by the user. The user then can use the PC to control air handling device 10 and optionally heat exchanger 50, or in a simpler system, control air handling device 10 and heat exchanger 50 manually.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A reversing shuttle for an air handling device, comprising:

a) a first portion connectable to a fan inlet such that said first portion is in fluid communication with said fan inlet;

b) a second portion connectable to a fan outlet such that said second portion is in fluid communication with said fan outlet;

c) a third portion connectable to a duct network such that said third portion is in fluid communication with said duct network;

d) a first damper in fluid communication with said first portion;

e) a second damper in fluid communication with said second portion;

f) said first and second dampers being opposable dampers such that when said first damper is closed, said second damper is open, and vice versa;

g) a diverter damper disposed in said reversing shuttle such that said diverter damper prevents fluid communication between said first portion and said second portion;

h) said diverter damper having a first position wherein said second portion and said third portion are in direct fluid communication and a second position wherein said first portion and said third portion are in direct fluid communication; and i) actuating means for actuating said first damper, said second damper, and said diverter damper such that when said diverter damper is in said first position, said first damper is open and said second damper is closed and when said diverter damper is in said second position, said first damper is closed and said second damper is open.

2. A reversing shuttle according to claim 1, further comprising control means for controlling said actuating means.

3. A reversing shuttle according to claim 2, wherein said control means includes means for a user to manually control said actuating means.

4. A reversing shuttle according to claim 2, wherein said control means includes means for automatically controlling said actuating means based on feedback from a sensor.

5. A reversing shuttle according to claim 2, wherein said control means includes means for automatically controlling said actuating means based on time of day.

6. A reversing shuttle according to claim 2, wherein said control means includes remote control means for controlling said actuating means based on input from a user.

7. A reversing shuttle according to claim 2, wherein said control means includes a computer and display.

* * * * *